US005857608A

United States Patent [19]

Liau

[11] Patent Number: 5,857,608

[45] Date of Patent: Jan. 12, 1999

[54] STAPLER

[76] Inventor: Su-Yon Liau, P.O. Box 453, Taichung, Taiwan

[21] Appl. No.: 985,570

[22] Filed: Dec. 5, 1997

[51] Int. Cl.[6] ..... B25C 1/04

[52] U.S. Cl. ..... 227/134; 227/120; 227/113

[58] Field of Search ..... 227/134, 113, 227/152, 120, 156

[56] References Cited

U.S. PATENT DOCUMENTS

| | | | |
|---|---|---|---|
| 1,810,528 | 6/1931 | Peterson | 227/113 |
| 3,083,367 | 4/1963 | Ruskin | 227/134 |
| 4,424,929 | 1/1984 | Weis | 227/113 |
| 4,616,774 | 10/1986 | Yasuda | 227/113 |
| 5,263,628 | 11/1993 | Huang | 227/134 |

FOREIGN PATENT DOCUMENTS

| | | | |
|---|---|---|---|
| 964407 | 5/1957 | Germany | 227/113 |
| 2850316 | 6/1979 | Germany | 227/113 |
| 52-69071 | 6/1977 | Japan | 227/113 |

*Primary Examiner*—Scott A. Smith

[57] ABSTRACT

A stapler has a staple slot seat provided with a magnetic block which is located at the staple ejecting end of the staple slot seat. A staple admitting port is located at another end opposite to the staple ejecting end of the staple slot seat for loading staples such that the staples are caused to move toward the staple ejecting end by the attraction force of the magnetic block. The staple slot seat is further provided in the midsection thereof with a guide edge having a hook and an elastic member which is engaged with the hook for locating the staples in the staple slot seat.

1 Claim, 3 Drawing Sheets

STAPLER

FIELD OF THE INVENTION

The present invention relates generally to a desktop equipment, and more particularly to a stapler.

BACKGROUND OF THE INVENTION

As shown in FIG. 1, a prior art stapler 10 is composed of a staple seat 12, a tension spring 13, a sliding block 14. The staples 11 are located in the staple seat 12 such that the staples 11 are pushed forward by the sliding block 14 which is linked with the tension spring 13, and that the staples 11 are located between the locating edges 15 of the staple seat 12. As the staple 11 is located on the stopping plate 17 of the staple ejecting slot 16, the staple 11 is ready to be ejected.

Such a prior art stapler 10 as described above is defective in design in that it is complicated in construction, and that the staples 11 can not be easily loaded.

SUMMARY OF THE INVENTION

The primary objective of the present invention is to provide an improved stapler which is free from the structural deficiencies of the prior art stapler.

In keeping with the principle of the present invention, the foregoing objective of the present invention is attained by a stapler which is characterized in design in that its staple ejecting slot is provided at the front edge thereof with a magnetic block, and that its staple slot seat is provided at the rear end thereof with two lugs for forming a staple admitting port.

The foregoing objective, features, functions and advantages of the present invention will be more readily understood upon a thoughtful deliberation of a preferred embodiment of the present invention with reference to the accompanying drawings.

DETAILED DESCRIPTION OF THE EMBODIMENT

Figure 1:
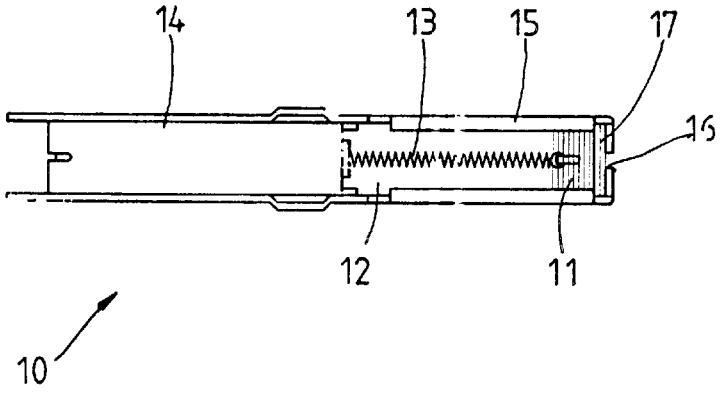
FIG.1 PRIOR ART
FIG. 1 shows a top view of a stapler of the prior art.
Figure 2:
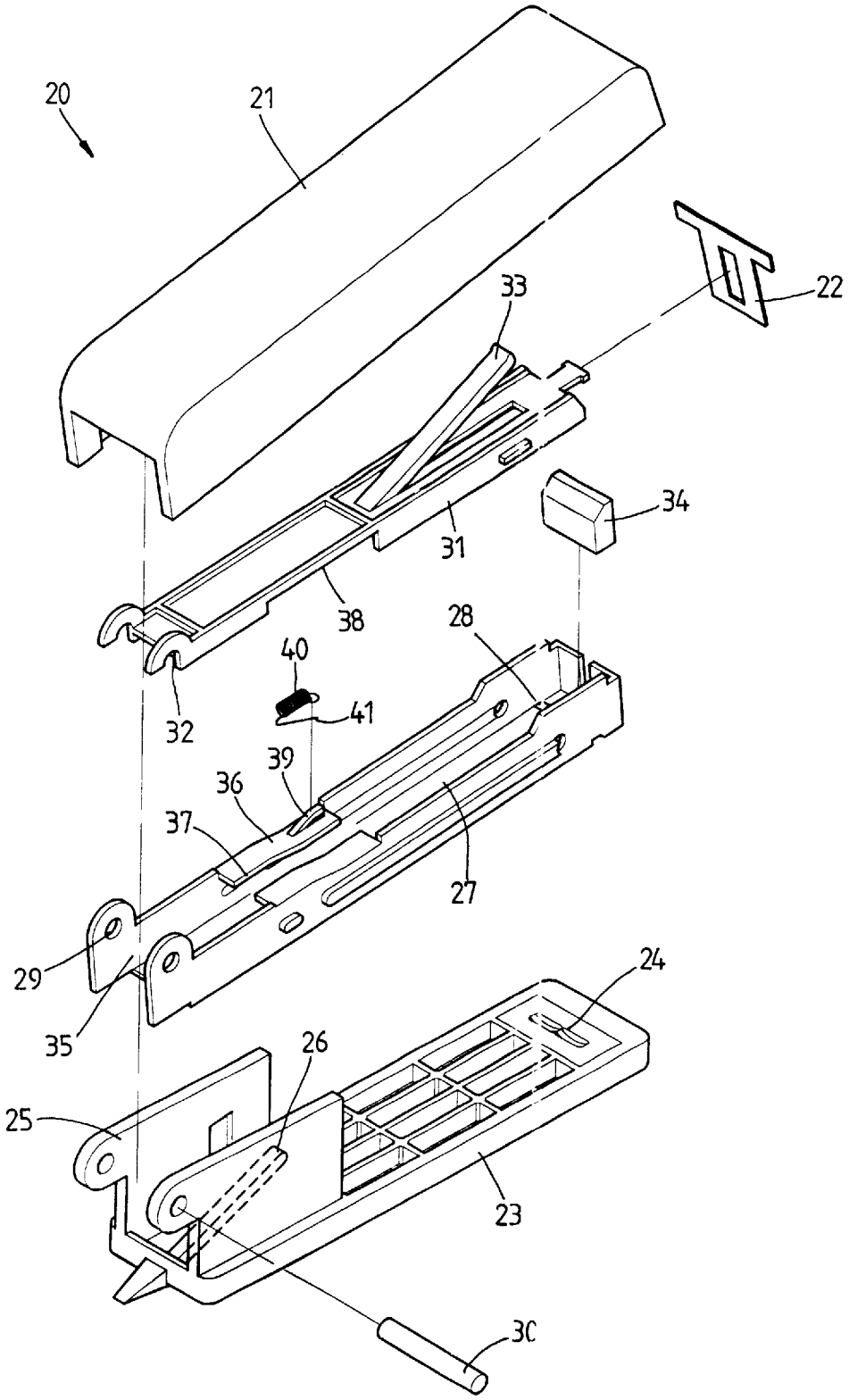
FIG. 2 shows an exploded view of a stapler of the present invention.
Figure 3:
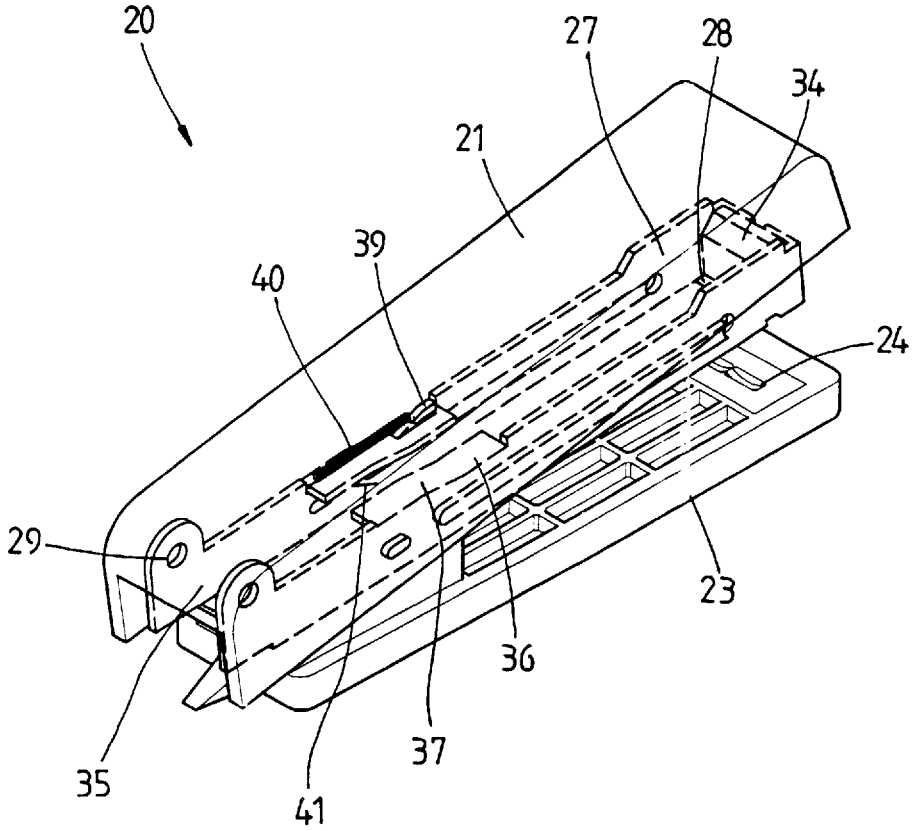
FIG. 3 shows a perspective view of the stapler of the present invention in combination.
Figure 4:
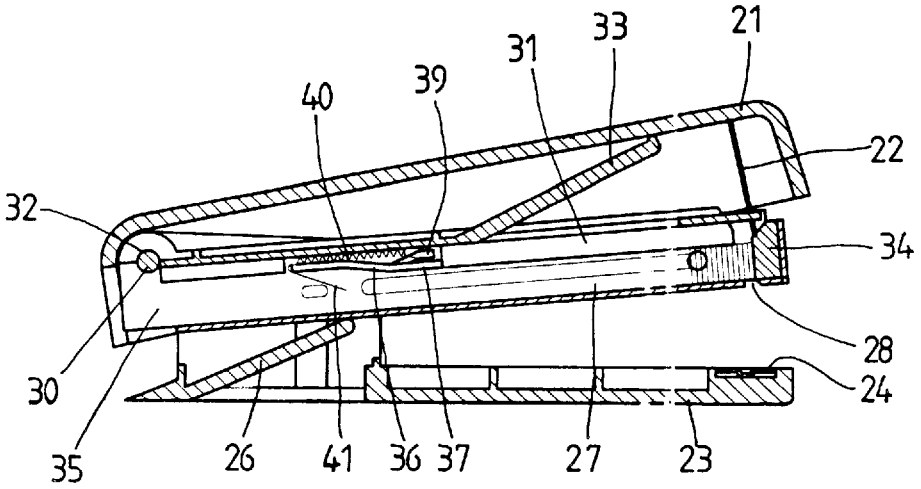
FIG. 4 shows a side view of the stapler of the present invention.

As shown in FIGS. 2–4, a stapler 20 embodied in the present invention is composed of the component parts, which are described hereinafter.

A cap 21 is provided in the inside of the front end thereof with a staple pressing plate 22.

A base 23 is provided at the front end thereof with a staple bearing plate 24, and at the rear end thereof with two pivoting lugs 25 and an urging member 26.

A staple slot seat 27 is provided at the front end thereof with a staple ejecting slot 28, and at the rear end thereof with two lugs 29 which are fastened pivotally between the two pivoting lugs 25 by a pivot 30.

A clamping member 3 1 is provided at the rear end thereof with two retaining edges 32 rested on the pivot 30, and in the upper side thereof with a rod member 33. The front end of the clamping member 31 is mounted slidably on the staple pressing plate 22.

A magnetic block 34 is located in a staple ejecting end of the staple ejecting slot 28. A staple admitting port 35 is formed in the staple slot seat 27 under the lugs 29. The staples 42 can be fed into the staple slot seat 27 via the staple admitting port 35.

The staple slot seat 27 is provided in the midsection thereof with a fold edge 37 having a guide edge 36. The clamping member 31 is provided at the midsection thereof with a prevention edge 38. The guide edge 36 is provided with a hook 39 engaged with an elastic member 40 having an elastic arm 41 for locating the staples 42.

The staples 42 are fed into the stapler 20 via the staple admitting port 35 and are subsequently moved forward by the attraction force of the magnetic block 34. In the meantime, the staples 42 are located in the staple slot seat 27 by the guide edge 36 located in the midsection of the staple slot seat 27. The staples 42 are loaded with precision, thanks to the elastic arm 41 of the elastic member 40.

What is claimed is:

1. A stapler comprising:

a cap provided at a front end thereof with a staple pressing plate;

a base provided at a rear end thereof with two pivoting lugs;

a staple slot seat provided at a rear end thereof with two lugs and mounted on said base such that said two lugs are fastened pivotally with said two pivoting lugs of said base by means of a pivot, said staple slot seat further provided with a staple ejecting slot, said staple ejecting slot provided at a staple ejecting end thereof with a magnetic block, said staple slot seat still further provided with a staple admitting port located between said two lugs of said staple slot seat for feeding staples such that the staples are caused to move toward said staple ejecting end by attraction force of said magnetic block; and a clamping member provided at a rear end thereof with two retaining edges and mounted on said staple slot seat such that said two retaining edges are engaged with said pivot;

wherein said staple slot seat is provided in a midsection thereof with a guide edge having a hook, and an elastic member engaged with said hook for locating the staples in said staple slot seat.

* * * * *